US009003813B2

(12) United States Patent
MacDonald

(10) Patent No.: US 9,003,813 B2
(45) Date of Patent: Apr. 14, 2015

(54) ENHANCED SURFACE COOLING OF THERMAL DISCHARGES

(75) Inventor: Daniel G. MacDonald, Mashpee, MA (US)

(73) Assignee: University of Massachusetts, Boston, MA (US)

( * ) Notice: Subject to any disclaimer, the term of this patent is extended or adjusted under 35 U.S.C. 154(b) by 1674 days.

(21) Appl. No.: 12/448,223

(22) PCT Filed: Dec. 14, 2007

(86) PCT No.: PCT/US2007/025547

§ 371 (c)(1),
(2), (4) Date: Sep. 29, 2010

(87) PCT Pub. No.: WO2008/076331

PCT Pub. Date: Jun. 26, 2008

(65) Prior Publication Data

US 2011/0011556 A1 Jan. 20, 2011

Related U.S. Application Data

(60) Provisional application No. 60/874,796, filed on Dec. 14, 2006, provisional application No. 60/878,602, filed on Jan. 4, 2007.

(51) Int. Cl.
*F25D 3/08* (2006.01)
*E02B 1/00* (2006.01)

(52) U.S. Cl.
CPC ..... *E02B 1/003* (2013.01)

(58) Field of Classification Search
USPC ..... 165/45, 60; 62/1, 91; 122/1
See application file for complete search history.

(56) References Cited

U.S. PATENT DOCUMENTS

| | | | | |
|---|---|---|---|---|
| 4,047,093 | A | 9/1977 | Levoy | |
| 4,291,540 | A | 9/1981 | Shields | |
| 2005/0092261 | A1 * | 5/2005 | Newman | 122/1 C |
| 2005/0230325 | A1 | 10/2005 | Miller | |
| 2005/0235625 | A1 | 10/2005 | Gericke et al. | |
| 2006/0180306 | A1 | 8/2006 | Stone | |
| 2010/0230071 | A1 * | 9/2010 | Slater | 165/45 |

OTHER PUBLICATIONS

Armi et al., Maximal two-layer exchange through a contraction with barotropic net flow. J Fluid Mech. 1986;164:27-51.

Armi, The hydraulics of two flowing layers with different densities. J Fluid Mechanics. 1986;163: 27-58.

Doneker et al., Expert Systems for Hydrodynamic Mixing Zone Analysis of Conventional and Toxic Single Port Discharges (CORMIX1). Technical Report EPA/600/3-90/012, U.S. EPA Environmental Research Laboratory, Athens, GA. Feb. 1990.

Farmer et al., Maximal two-layer exchange over a sill and through the combination of a sill and contraction with barotropic flow. J Fluid Mech.1986;164:53-76.

(Continued)

*Primary Examiner* — Melvin Jones
(74) *Attorney, Agent, or Firm* — Wolf, Greenfield & Sacks, P.C.

(57) ABSTRACT

A water discharge system enhances heat transfer to the atmosphere by limiting the mixing of heated discharge water with the ambient water of a receiving water body. The heated water is maintained near the top surface of the receiving water body which increases the transfer of heat to the atmosphere as compared to a system where the discharge water is mixed quickly with the ambient water.

27 Claims, 8 Drawing Sheets

(56) References Cited

OTHER PUBLICATIONS

Fischer et al., Design of ocean wastewater discharge systems. Chapter 10 in Mixing in Inland and Coastal Waters. Academic Press, San Diego. 1979. pp. 390-441.
Fischer et al., Surface thermal energy transfer. Section 6.2.2 in Mixing in Inland and Coastal Waters. Academic Press, San Diego. 1979. pp. 162-167.
Harleman, Mechanics of condenser-water discharge from thermal-power plants. Chapter 5 in Engineering Aspects of Thermal Pollution, Parker and Krenkel, eds. Vanderbilt University Press, Nashville, TN. 1969. pp. 144-176.
Kashiwamura et al., Outflow pattern of fresh water issued from a river mouth. Coastal Engineering in Japan. 1967;10:109-115.
MacDonald et al., Turbulent energy production and entrainment at a highly stratified estuarine front. J Geophys Res. 2004;109(C05004):1-17. doi:10.1029/2003JC002094.
Corrected International Search Report and Written Opinion mailed Nov. 4, 2010 in connection with Application No. PCT/US07/25547.
Corrected International Preliminary Report on Patentability mailed Nov. 17, 2010 in connection with Application No. PCT/US07/25547.

* cited by examiner

ENHANCED SURFACE COOLING OF THERMAL DISCHARGES

CROSS-REFERENCE TO RELATED APPLICATIONS

This application is a national stage filing under 35 U.S.C. §371 of international application PCT/US2007/025547, filed Dec. 14, 2007, which claims the benefit under 35 U.S.C. §119(e) of U.S. provisional application Ser. No. 60/874,796, filed Dec. 14, 2006 and U.S. provisional application Ser. No. 60/878,602, filed Jan. 4, 2007.

FIELD OF INVENTION

The invention relates generally to cooling heated discharge water, and more specifically to improving the atmospheric cooling of heated water discharged to a receiving water body.

DESCRIPTION OF RELATED ART

The prevailing wisdom in the design and construction of outfalls often can be summed up by the adage "the solution to pollution is dilution". Outfalls are typically designed to mix the discharging effluent into background waters as efficiently and quickly as possible, in order to reduce contaminant concentrations and/or water temperatures. This mixing is typically accomplished by using high fluid velocities at the outfall created by narrow discharge channels, or by using specially designed nozzles associated with offshore bottom diffusers connected to a shore-based industry or treatment facility via subsurface piping. The textbook, *Mixing in Inland and Coastal Waters* (Fischer et al., 1979) addresses design issues related to maximal mixing. The United States Environmental Protection Agency (EPA) has adopted this approach through the establishment of rules and regulations regarding "mixing zones," that is, specifically defined regions surrounding an outfall where temperatures and/or contaminant concentrations can exceed levels deemed acceptable for the water body as a whole. This approach allows space for the discharge to mix adequately with ambient waters. In the 1990s, EPA contracted Cornell University to develop an expert system for evaluating mixing zones and diffuser efficiencies, known as the CORnell MIXing zone expert system (CORMIX, see Doneker and Jirka, 1990, and www.cormix.info). Approximately 60% of existing U.S. power generation facilities, a total of approximately 400 plants, employ an open cycle method for extracting waste heat from the electricity generating process. Under this method, water is extracted from a nearby water body, used as cooling water within the plant, and then directly discharged back to the water body. In recent years, potential impacts of such waste heat streams on the environment have been debated, with little overall consensus, on either a general or case by case basis. Without clear scientific guidance upon which to rely, many regulatory entities, including the USEPA and state agencies, have chosen the conservative approach of mandating closed cycle cooling at locations where there is a potential for impact. Closed cycle cooling involves the use of recycled cooling water, and requires the construction of extremely costly on-site cooling towers. To date, few, if any, existing U.S. facilities have been retrofitted with a full scale cooling tower system, due primarily to high cost, which can be estimated to exceed $100 million in many cases.

SUMMARY

According to embodiments of the invention, a water discharge system is designed to enhance heat transfer to the atmosphere by limiting the mixing of heated discharge water with the ambient water of a receiving water body. The heated water is maintained near the top surface of the water body which increases the transfer of heat to the atmosphere as compared to a system where the discharge water is mixed quickly with the ambient water. Several embodiments of methods and systems which facilitate this surface cooling are disclosed herein, although other methods and systems may be used.

According to one aspect of the invention, a system for transferring heat from cooling system discharge water to the atmosphere includes a discharge conduit that is configured to receive cooling system discharge water from a cooling system, and is further configured to deliver the cooling system discharge water at an initial temperature $T_o$ to a large receiving water body containing ambient water. The system is constructed and arranged to limit mixing of the discharge water with the ambient water to such an extent that a surface cooling scaling factor, E, defined as:

$$E = \frac{Q_o}{Q}\left(1 - \frac{H}{H_o}\right)$$

is greater than or equal to 0.01 when a ratio $T/T_o$ is less than 0.9 and greater than 0.1, wherein $Q_o$ represents an initial volume flux of discharge water being discharged into the receiving water body, Q represents a volume flux of water including both the initial discharge water volume $Q_o$ and the water into which the initial discharge water volume is mixed, $H_o$ is the initial excess heat flux of volume $Q_o$ of the discharge water, H is the excess heat flux from the discharge water associated with the volume flux Q, and T is the mean temperature associated with volume flux Q. According to another aspect of the invention, a method includes operating such a system.

According to another aspect of the invention, a system for transferring heat from cooling system discharge water to the atmosphere includes a discharge conduit that is configured to receive cooling system discharge water from a cooling system, and is further configured to deliver the discharge water of a selected flow rate and density to a large receiving water body at a mouth of the conduit. The discharge conduit has a bottom, a length, a width profile and a depth profile. The large receiving water body contains water of a selected density. The discharge conduit is constructed and arranged such that the discharge water having the selected flow rate and density lifts off from the bottom of the discharge conduit upstream from the mouth of the conduit or substantially at the mouth of the conduit, and the lift off allows intrusion of the ambient water under the discharge water. According to another aspect of the invention, a method includes determining a configuration of a conduit to achieve lift off of water discharge, and further includes constructing the conduit.

According to a further aspect of the invention, a method of transferring heat from cooling system discharge water to the atmosphere includes delivering cooling system discharge water of a selected flow rate and density to a large receiving water body at a mouth of the conduit. The receiving water body contains ambient water and has a top water surface and a bed. The method also includes flowing the discharge water over an upper end of a weir positioned at or downstream of the mouth of the conduit, with the weir extending from the bed of the receiving water body to a height below the top water surface. The weir is configured such that the discharge water remains at least as close to the top water surface of the receiving water body as the upper end of the weir in downstream proximity to the weir.

According to another aspect of the invention, a system for separating a zone of density gradient within water of a water discharge system from a zone of velocity shear within the water of the system includes a discharge conduit configured to deliver cooling system discharge water to a large receiving water body which contains ambient water, and the discharge water has a density and a velocity at a first longitudinal position within the system. The system further includes a flow introducer being configured to introduce a cushioning flow of water into the system at the first longitudinal position and under the discharge water, the flow introducer being further configured to introduce the cushioning flow of water at an initial velocity substantially equal to or less than the velocity of the discharge water above the cushioning water. The flow introducer is fluidically connected to a supply of water having a density that is: (a) less than or substantially equal to the density of the discharge water; and (b) greater than or substantially equal to a density of the ambient water.

According to another aspect of the invention, a system for producing a diffuse velocity gradient within a flow of cooling system discharge water includes a discharge conduit configured to deliver cooling system discharge water to a large receiving water body that contains ambient water. The system includes a porous structure positioned in the conduit and/or the receiving water body, and the porous structure has a higher permeability toward the top of the structure than a permeability toward the bottom of the structure.

All aspects of the invention need not be present in various embodiments of the invention, although one embodiment may instantiate multiple aspects.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

While the approach of mixing effluent as quickly and efficiently as possible into background waters may be effective in many cases, particularly for chemical contaminants, including organic and/or nutrient loading, the inventor has recognized that such an approach may not be the best alternative for heat discharges in certain cases. Heat is distinct from other contaminants in that it is readily transferred across the surface of the water body to the overlying air mass through a variety of mechanisms, including evaporation (latent heat flux) and conduction (sensible heat flux), both of which are functions of the temperature difference between the sea surface and the overlying air. In cases where there is a limited replacement of water within the water body receiving the discharge, for example, through tidal exchange, river inflow, or other mechanisms, efficient mixing of the discharge moves heat away from the surface and into longer-term storage at depth. In these cases, the inventor has recognized that limiting mixing and spreading the discharging fluid in a thin layer across the surface to take advantage of the natural air-water heat exchange mechanisms may be more desirable. Use of various embodiments disclosed herein, or combinations of embodiments disclosed herein, may achieve levels of heat transfer to the atmosphere which are not possible with existing systems at typical flow rates.

Figure 1:
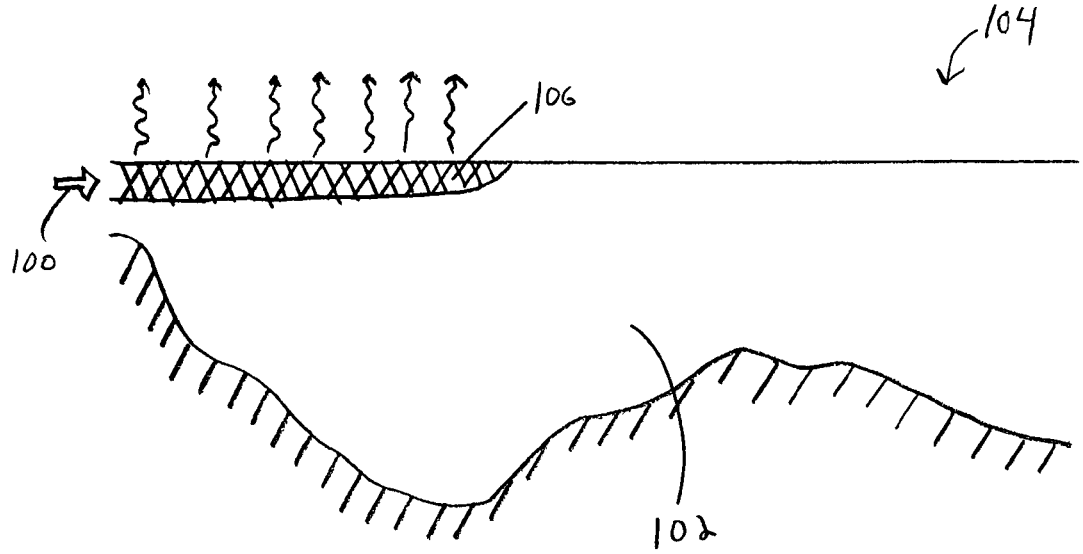
FIG. 1 is profile view of a discharge of heated water into a receiving water body according to one embodiment of the invention.

FIG. 1 schematically illustrates how a heated water discharge 100 that is not strongly mixed with ambient waters 102 of a large receiving water body 104 forms a thin layer 106 of discharge water along the top of water body 104. The thin layer of discharge water transfers energy to the atmosphere via evaporation and conduction. A large receiving water body may include a pond, a lake, a river, a bay, an ocean, a harbor or any other suitable water body.

Figure 2:
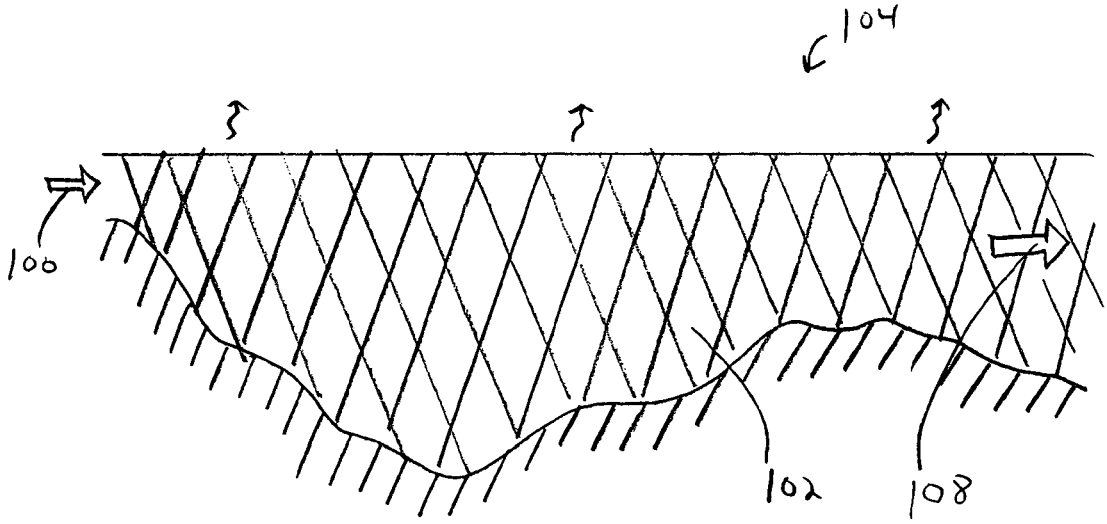
Fig. 2 (Prior Art)
FIG. 2 is a profile view of a discharge of heated water into a receiving water body according to a prior art embodiment.

Typical prior art discharge systems intentionally mix heated water discharge 100 as quickly as possible to reduce the temperature of the discharged water. This approach, shown schematically in FIG. 2, transfers a larger portion of discharge water heat to the ambient waters of receiving water body 102 than the novel approach shown in FIG. 1. In the system of FIG. 2, excess heat is flushed from the system via the movement of water 108 out of water body 104.

It is well known that turbulence and mixing are induced by velocity shear, typically arising from interaction of the fluid with a solid boundary, such as the bottom of a channel, or from the difference in velocity between two adjacent water masses, such as a jet flowing into quiescent water. In both cases, the resulting turbulent kinetic energy produced can be shown to be related to the square of the velocity shear ($\Delta u$). Recent evidence suggests that bottom induced turbulence can be up to ten times as intense as turbulence driven by the shear between adjacent layers (see, e.g., MacDonald and Geyer, 2004).

It has also been long recognized that a vertical density gradient can suppress turbulence in a fluid. This effect can be characterized by a gradient Richardson number, $$Ri_g = -\frac{g}{\rho}\frac{\partial \rho}{\partial z}\left(\frac{\partial u}{\partial z}\right)^{-2},$$

where g represents gravity, ρ is the density of the fluid, u is the horizontal velocity of the fluid, and z is the vertical direction. A value of $Ri_g < 1/4$ is typically accepted as a necessary condition for the generation of turbulence. For practical reasons, it is often easier to calculate a bulk Richardson number, $Ri_B = g'h_1(\Delta u)^{-2}$, where g' is a reduced gravity defined as $$g' = g\frac{\Delta\rho}{\rho_o},$$

g is gravitational acceleration, Δρ represents the difference in density between the discharged and receiving waters, $\rho_o$ is a reference density (typically equal to 1000 kg/m$^3$), $h_1$ is the thickness of the discharging fluid layer, and Δu represents the difference in mean horizontal velocity between the discharging fluid and the ambient fluid. In this case, conditions can be considered sufficient for the suppression of turbulence if $Ri_B$ is much greater than one.

Thus, to limit mixing, it may be advantageous for discharge water to:

(1) lose contact with the bottom, so that the discharge water advances over a layer of ambient water;

(2) have a velocity reduced as much as practicable; and/or (3) be characterized by a high value of $Ri_g$ and/or $Ri_B$.

Embodiments disclosed herein enhance surface cooling by discharging heated water in a manner that results in a thin surface layer of the discharged water. Several embodiments are described which accomplish such a result for discharge via conduit, such as a channel, canal or a pipe, for example.

Figure 3:
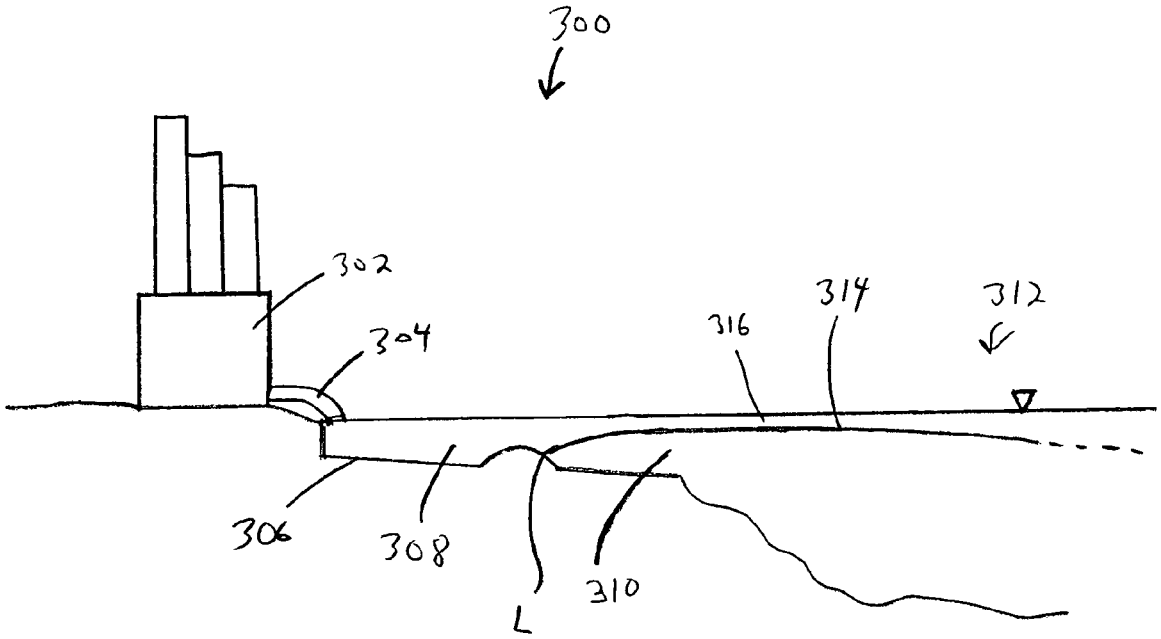
FIG. 3 is a profile view of a water discharge system according to one embodiment of the invention.

One embodiment of a water discharge system 300 associated with a power plant 302 or other industrial facility is schematically illustrated in FIG. 3. Power plant 302 includes a cooling system that generates heated water. The heated water is discharged through any suitable conduit, such as a pipe 304, to a canal 306, a pipe, or any other suitable outfall conduit. Discharge water 308 flows downstream through canal 306, and "lifts off" from the bottom of the canal (in this example, at point L) such that ambient waters 310 of a receiving water body 312 enter the canal below discharge water 308. Line 314 demarcates the boundary between discharge water 308 and ambient water 310. Lift off of the buoyant water from the bottom reduces mixing resulting from bottom drag, thereby allowing the discharge water to advance as a layer 316 on top of ambient water 310.

It should be noted that while embodiments herein are discussed in the context of discharge water and ambient water, liquids, solids and gases other than water may be contained within discharge or ambient water (sometimes in high concentrations) and the discharge water and/or ambient water would still be considered water. In some cases, a discharge liquid other than water may be used as part of a method or system disclosed herein. Additionally, while an uncovered channel is shown and described as one example of a discharge conduit, other suitable conduits may be used, such as a pipe (above ground or underground) or a canal (covered or uncovered) as two examples.

Figure 4:
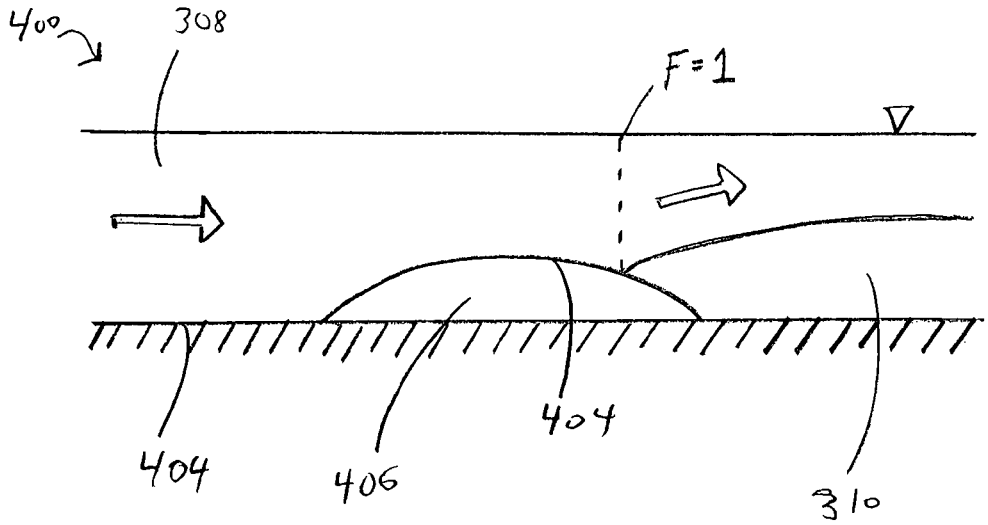
FIG. 4 is a profile view of a discharge conduit according to one embodiment of the invention.

To initiate lift off, in a first embodiment illustrated in FIG. 4, a conduit 400 is configured so that there is an intrusion of ambient water 310 into conduit 400, allowing discharge water 308, which is more buoyant than the receiving waters, to lift-off and lose contact with the bottom 404 of conduit 400. Typically, a discharge Froude number value sufficiently less than one at a mouth (not shown in FIG. 4) of a conduit allows intrusion of receiving waters into the conduit. Here, the discharge Froude number can be defined as:

$$F = \frac{Q_o}{A(g'h)^{\frac{1}{2}}} \tag{1}$$

where $Q_o$ is the total discharge flowrate, A is the cross-sectional area of the channel at the longitudinal position in question along the length of the channel (e.g., the width of the channel multiplied by the average depth), and h is the local depth of water at a lateral position within the cross-section. Accordingly, the discharge Froude number may vary laterally across the channel at a given longitudinal position. Accordingly, for purposes herein, when the discharge Froude number is described as being equal to a value X at a longitudinal position Yin a conduit, the description is referring to the discharge Froude number having a value X at at least one position across the width of the channel at that longitudinal position. Note that F is similar in form to $Ri_B^{-1}$, with the exception that the full water depth, h, is used in the definition of F, whereas only the thickness of the discharging layer, $h_1$, is used in the definition of $Ri_B$.

As also shown in FIG. 4, upstream from the mouth, an expansion in conduit depth, in this case formed by a constriction in the conduit, such as a bump 406, may be used to generate a longitudinal position where the flow converts (in the downstream direction) from having a discharge Froude number value of greater than one to having a discharge Froude number value of one, which will generally define the location where the buoyant discharge fluid lifts off from the bottom of the conduit.

In other embodiments, a discharge Froude number condition of F=1 may be triggered by an increase in the conduit width and/or depth without a prior constriction. As illustrated in the plan view of FIG. 5 and profile view of FIG. 6, a narrow upstream portion 502 of a conduit 500 carries a flow having a discharge Froude number value of greater than one, and the conduit widens such that the discharge Froude number value of the flow decreases to substantially one at a longitudinal position 504, triggering lift off of the buoyant discharge. A similar effect may be realized by an increase in the depth of a conduit, as described in a prophetic example below with reference to FIG. 7.

Figure 7:
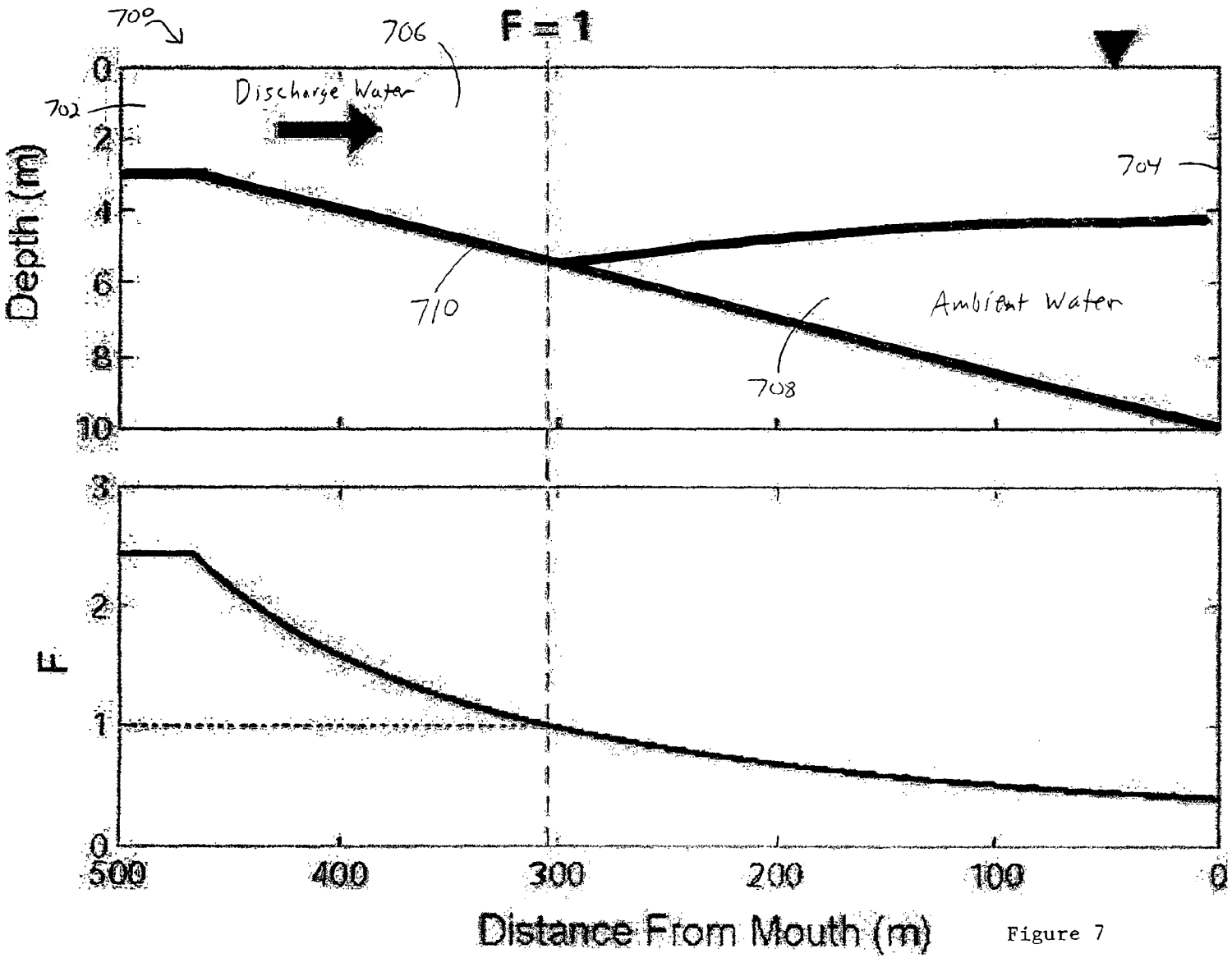
FIG. 7 is a profile view of one embodiment of a discharge conduit and an accompanying graph showing discharge Froude number values.

A profile view of a discharge channel 700 with a rectangular cross section and a constant width of 20 meters is illustrated in FIG. 7. An upstream portion of channel 702 is three meters deep, then gradually deepens at a slope of 0.015 m/m until reaching a depth of ten meters at a mouth 704. Discharge water 706 comprising fresh water with a temperature of 30° C. is discharged through the channel at a rate of 40 m$^3$ s$^{-1}$ into a reservoir of ambient water 708 comprising fresh water with a temperature of 20° C.

A depth profile and discharge Froude number profile long the length of the channel are presented in the graph below the channel diagram. Liftoff from a bottom 710 of the channel occurs at x≈305 m, where F=1.

Even with lift off of the buoyant fluid from a conduit bottom, velocity shear between the discharging fluid and receiving water layers also generates turbulent mixing. To further reduce mixing, in some embodiments, the mouth of the conduit may be made as wide as practicable in order to reduce discharge velocities, and increase local values of $Ri_g$ and/or $Ri_B$. A target width may be based on laboratory experiments of river discharges (Kashiwamura and Yoshida, 1967) so that the following is satisfied:

$$\frac{g'^{(0.0453)}\upsilon^{(0.6994)}b^{(1.4507)}}{Q} > 0.7 \quad (2)$$

where b is the width of the mouth, and ν is the kinematic viscosity of the fluid. In many practical cases, the inequality described in (2) may not be achievable due to spatial constraints, but it is provided here as a target limit.

Figure 8:
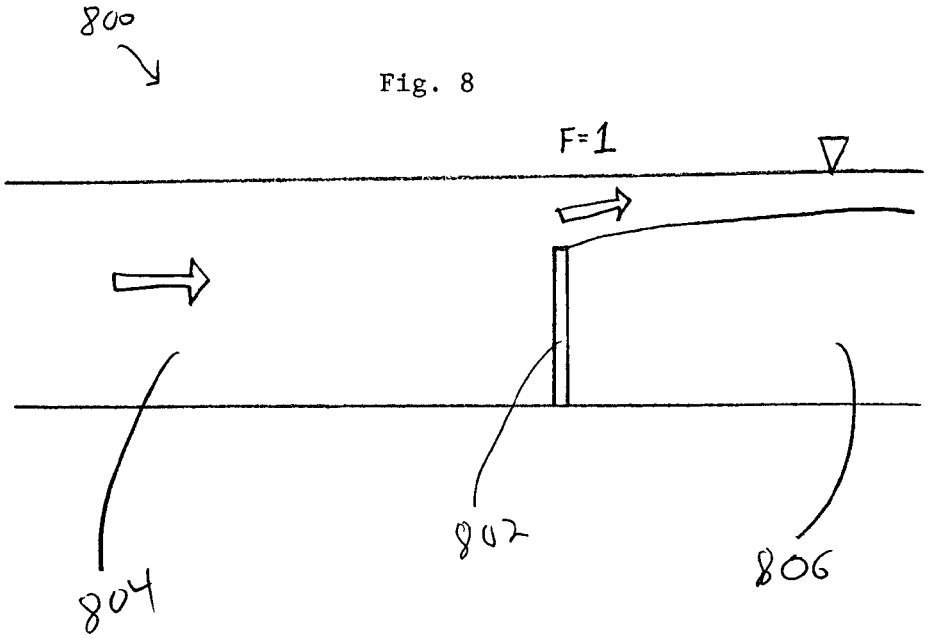
FIG. 8 is a profile view of a discharge conduit to another embodiment of the invention.
Figure 9:
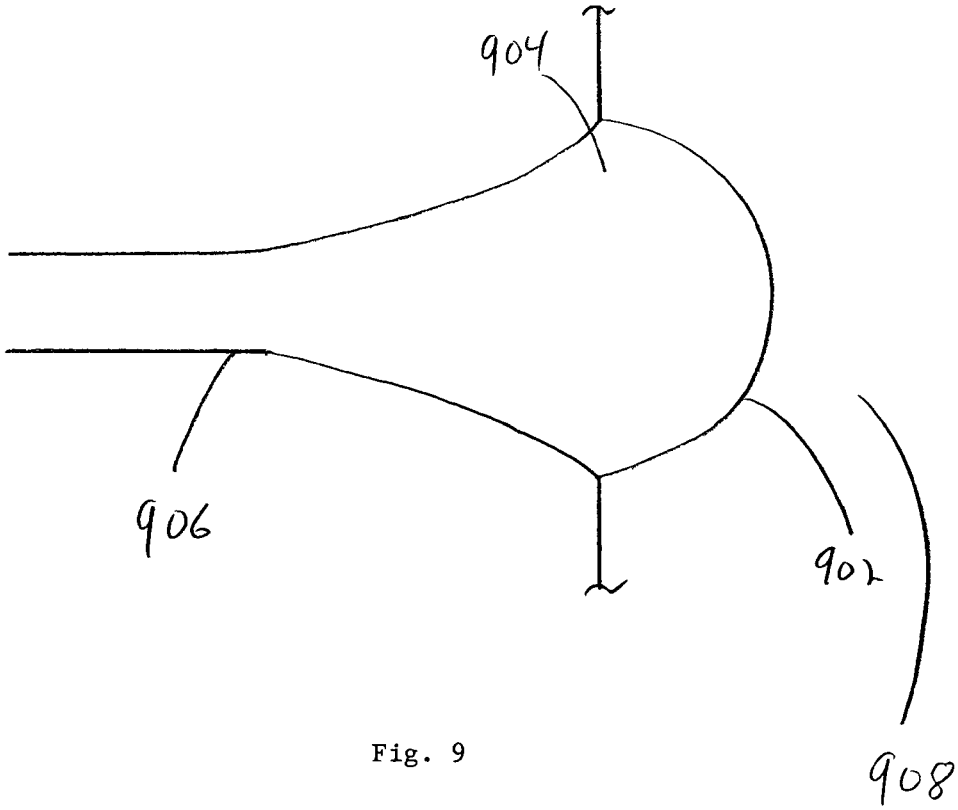
FIG. 9 is a top view of a discharge system according to another embodiment of the invention.

As illustrated in FIGS. 8 and 9, various embodiments of discharge channels include the use of a submerged weir structure between a flow of discharge water and ambient receiving waters of a receiving water body to direct the discharge water toward the surface of the receiving water body. In the embodiment of FIG. 8, a weir 802 is positioned within channel 800, and the depth of the top of the weir from the top surface of the water, $h_w$ and the length of the weir, $b_w$, may be designed so that the discharge Froude number at the weir, as defined in Equation (1), using $A=h_w \cdot b_w$ and $h=h_w$ is equal to substantially one, thereby initiating lift off of discharge water 804 over ambient water 806 at weir 802.

In some embodiments, as in FIG. 8, weir 802 is positioned within the conduit, that is, upstream of the conduit mouth, while in other embodiments the weir may be positioned at the conduit mouth, just outside the conduit mouth, or in the receiving water body. For example, in the embodiment of FIG. 9, a weir 902 (shown in plan view) is positioned just outside a mouth 904 of a channel 906 and within a receiving water body 908. For purposes herein, the phrase, "a weir positioned in the conduit and/or the receiving water body" means a weir that is positioned entirely within the conduit, a weir that is positioned entirely within the receiving water body, or a weir that straddles the interface of the two.

To reduce the velocity of the discharge water for a selected flow rate as the water flows over the weir, instead of forming a straight line, the upper end of the weir may be configured to form a concave shape relative to the conduit, thereby increasing the length of the weir over which the water flows. One example of a weir having an upper end that has a concave shape relative to the conduit in a plan view is weir 902 shown in FIG. 9. The concave shape may include a portion of a circular arc, a non-circular curve, a series of linear sections, some combination thereof, or any other suitable shape.

For purposes herein, use of the term "selected" is not necessarily intended to indicate a choice of a superior value or parameter. The term "selected" is used to represent a value or parameter that is provided as a given or an existing condition, and/or to represent a value or parameter that a user selects as part of a design or modeling process.

Figure 5:
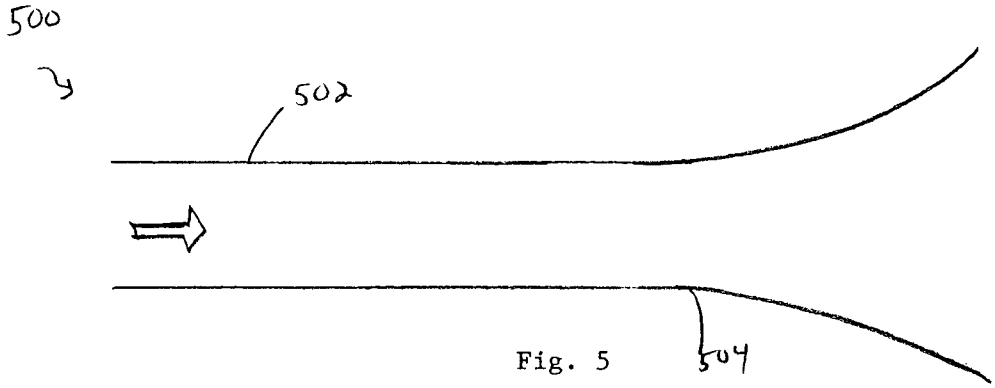
FIG. 5 is a top view of another embodiment of a discharge conduit.
Figure 6:
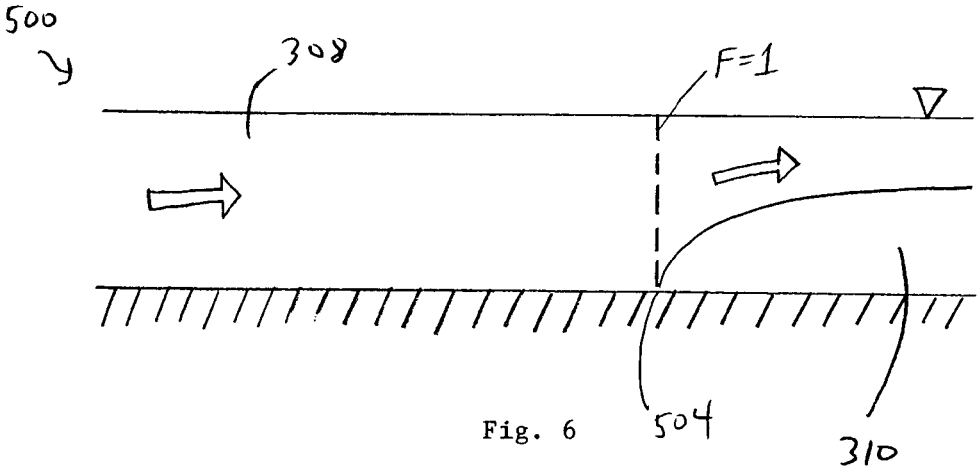
FIG. 6 is a profile view of the embodiment illustrated in FIG. 5.

For values of the discharge Froude number which are less than one, intrusion of receiving waters over the weir and into the discharge reservoir will likely occur, with the eventual possibility that the weir may no longer act as a point of hydraulic control, thereby pushing the point of liftoff upstream within the conduit, and effectively reverting to a configuration perhaps similar to the embodiments illustrated in FIGS. 4-6. Values of the discharge Froude number which are greater than one will not result in intrusion of ambient water over the weir, but may be characterized by velocities greater than necessary to achieve flow over the weir, perhaps triggering unwanted energetic mixing between the discharge water and the ambient water. However, in some embodiments, such as systems which discharge into a region with active tides, the weir could be designed so that the value of the discharge Froude number is time dependent, but is usually or always greater than or equal to one.

Figure 10:
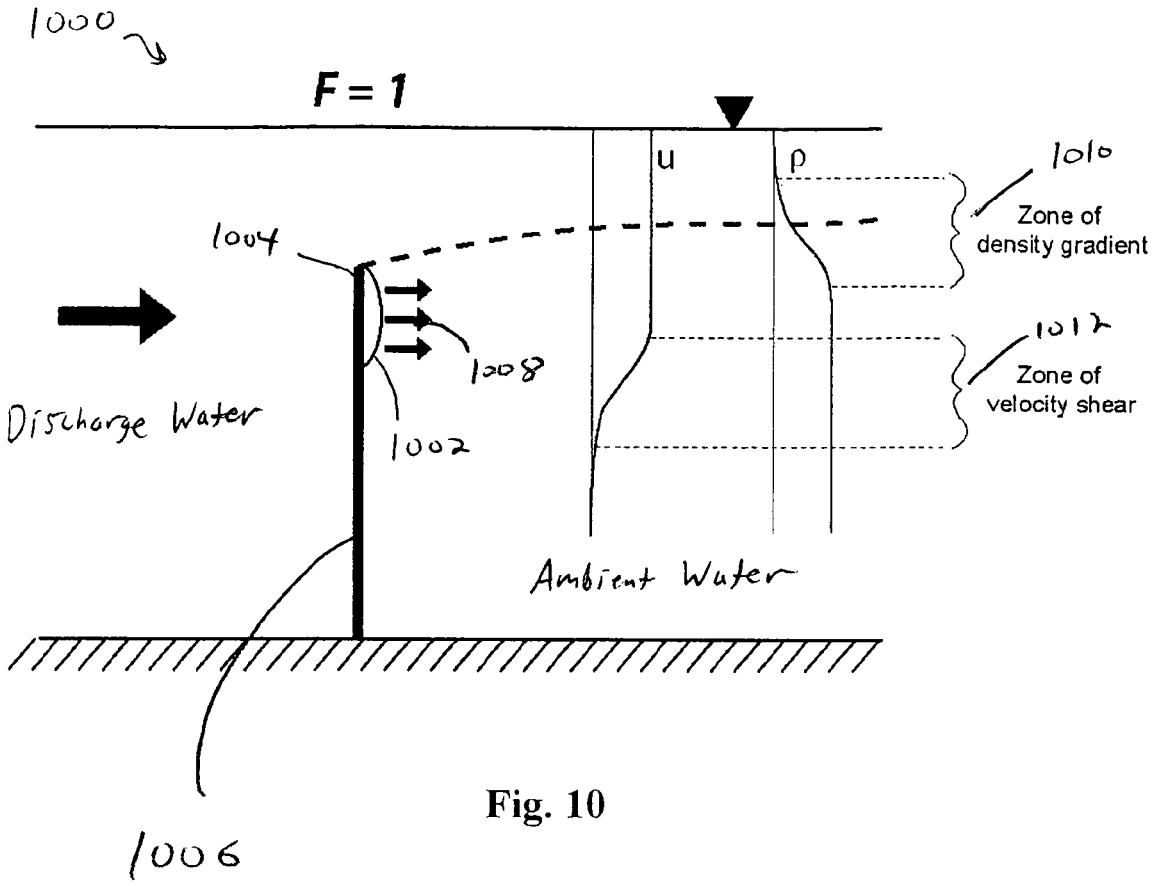
FIG. 10 is a profile view of a discharge conduit including a flow introducer according to a further embodiment of the invention.

For all of the embodiments described herein, optional enhancements may be included to alter the velocity profile associated with the discharging water to stabilize the flow and reduce mixing. In a first enhancement, a cushioning layer of ambient water may be discharged at or downstream of discharge water lift off in a channel 1000. For example, a diffuser 1002 or other flow introducer may be positioned just below an upper end 1004 of weir 1006, as illustrated in FIG. 10, to introduce a cushioning flow of ambient water 1008 that substantially matches the velocity of the discharge water, or is of sufficient velocity to generate values of $Ri_g$ greater than ¼. The cushioning flow separates a region of strong density gradients 1010 from a region of strong velocity shear 1012, so that values of $Ri_g$ within the region of strong density gradients remain large. According to some embodiments, ambient water is withdrawn from a region adjacent to the discharge location and pumped through diffuser 1002 to create a uniform layer of ambient water just below the base of the discharge water, at a velocity similar to that of the discharging water. The intake region for this cushioning flow may be characterized by liquid with a density comparable to the ambient water underlying the discharge. In some embodiments, the intake region may be in the receiving water body and/or in a region of the channel that contains ambient water which has moved into the canal.

In another embodiment of adding a cushioning flow below the discharge water flow, ambient water may be injected on the downstream side of bump 406 in the conduit of the embodiment illustrated in FIG. 4, to create a cushioning layer. Here again, the velocity of the cushioning flow may be substantially matched to the velocity of the discharge water, or of sufficient velocity to generate values of $Ri_g$ greater than ¼.

In some embodiments, instead of using ambient water for the cushioning flow, other water may be used which has a density that is less than or substantially equal to the density of the discharge water, and greater than or substantially equal to a density of the ambient water.

A flow introducer may be employed in a system that does not include a depth expansion. For example, a diffuser may be positioned on the bottom of a conduit to introduce a cushioning flow along the bottom of the conduit, and as the discharge water lifts off at a conduit width expansion, the cushioning flow becomes sandwiched between the discharge flow above and ambient water below.

In a second enhancement, the discharge structure is modified to create a velocity shear within the discharging water prior to contact with the underlying ambient water layer. Such a velocity profile broadens the shear zone, and thus reduces local velocity shear near the density interface in order to increase values of $Ri_g$, in some cases to values well above the critical value of ¼.

Figure 11:
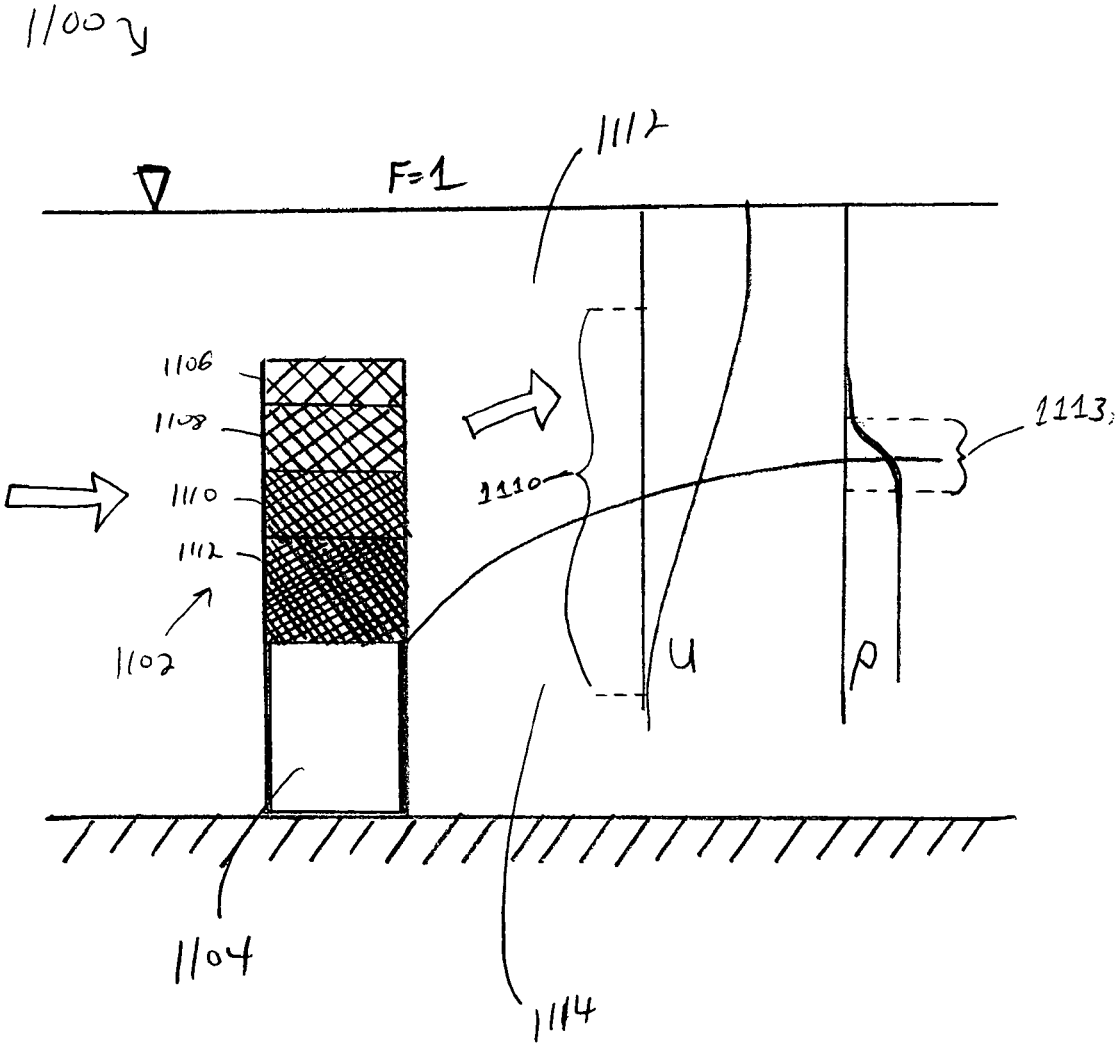
FIG. 11 is a profile view of a discharge conduit including a porous flow restriction structure according to another embodiment of the invention.

In some embodiments, creating a diffuse velocity shear within the discharge water is accomplished with a porous structure of variable permeability. For example, as illustrated in FIG. 11, in a channel 100, a porous discharge structure 1102 is placed on top of discharge weir 1104. Porous structure 1102 has a higher permeability in a first, top section 1106 than in a second, lower section 1108. Second section 1108 has a higher permeability than a third section 1110, and so on. A solid section 1104 may be positioned at the bottom. This configuration results in higher velocities on the downstream side of top section 1106 as compared to velocities on the downstream side of the lower sections 1108, 1109, 1110. In this manner, by creating a diffuse velocity gradient 1111, discharge water 1112 that flows over ambient water 1114 (the interface being characterized by a sharp density gradient 1113) has a reduced velocity and therefore reduced mixing.

While the embodiment illustrated in FIG. 11 includes a porous structure having discrete sections of different permeabilities, in some embodiments, permeability may vary continuously in portions of the porous structure or throughout the porous structure.

In many embodiments, the highest portions of the discharge may be unrestricted, with no porous structure impeding the progress of the flow, while lower portions of the discharge have increased flow restriction. With respect to porous discharge structures, discharge Froude numbers are calculated using the mean velocity across the entire discharge height.

Porous discharge structure 1102 may be positioned atop a weir as shown, or near the crest of bump 406 or on another depth constrictor. In some embodiments, the porous discharge structure may be positioned directly on a conduit bottom, such as near a width expansion that initiates lift off of the discharge water.

An additional possible advantage of a sheared velocity discharge structure is an enhanced protection against the intrusion of ambient waters over bump 406 or weir 1104, due to enhanced flow restriction at the base of the sheared velocity discharge structure.

Note that for the velocity structure described above, a velocity shear may be imposed within a region of uniform (or nearly uniform) density. This velocity shear may induce turbulence and mixing within the uniform density fluid, which will result in a reduction of the shear within the layer, but will predominately result in the mixing of uniform density fluid with itself and have little impact on dilution and temperature reduction. In some embodiments, some turbulence may be transported to the interface between the discharge water and the ambient water and result in some limited mixing between water masses. In many cases, this process occurs, however, over a time scale long enough for lateral spreading of the buoyant discharge to significantly increase the flow area and further reduce discharge velocities, thus decreasing the amount of energy available for mixing, and reducing the overall dilution which occurs.

As a measure of the amount of excess heat that is transferred to the atmosphere relative to the amount of excess heat transferred to the receiving water body, a surface cooling factor E may be calculated. The surface cooling factor E is defined for purposes herein as the dilution of the discharge water in the ambient water, $Q_o/Q$, multiplied by one minus the fraction of excess heat discharged to the water body that is remaining in the water body, i.e., $(1-H/H_o)$, or $$E=Q_o/Q*(1-H/H_o), \tag{3}$$

where $Q_o$ represents an initial volumetric flow rate of discharge water discharged into the receiving water body, Q represents a volumetric discharge of water at some location at or beyond the mouth, including both the initial discharge volumetric flux $Q_o$ and the water into which the initial discharge water volume is mixed, $H_o$ is the initial flux of excess heat associated with volumetric flux $Q_o$ of the discharge water, H is the flux of excess heat from the discharge water that is associated with diluted volumetric flux, Q.

The dilution of the discharge water may be determined by injecting a dye such as Rhodamine dye or Fluorosceine dye into the discharge water until a steady state concentration of dye is achieved near the discharge to the receiving water body. Detailed measurements of dye concentration, C, temperature, T, and horizontal velocity, u, can be made along a transect perpendicular to the centerline of the plume. The dilution factor $(Q_o/Q)$ is also equal to $C/C_o$ where C is the mean concentration of the dye (weighted by volumetric flux) at the transect and $C_o$ is the initial mean concentration of the dye at the discharge. The mean temperature of the plume water (weighted by volumetric flux) at the transect can also be calculated and the flux of excess heat at the transect is then determined by $H/H_o=(T/T_o)/(C/C_o)$, where T is the mean temperature of the water in the transect (weighted by volumetric flux) and $T_o$ is the mean initial temperature of the discharge water entering the receiving water body. Substituting these terms into Equation 3 above, E can be represented as:

$$E=C/C_o-T/T_o \tag{4}$$

For purposes herein, where uncertainty values of the dye concentration and temperature measurements are suitably low, measurement and calculation of E using Equation 4 above is a valid representation of $E=Q_o/Q*(1-H/H_o)$ in a discharge system.

Methods and instruments for measuring dye concentrations and temperatures within the receiving water body are described further below.

Figure 12:
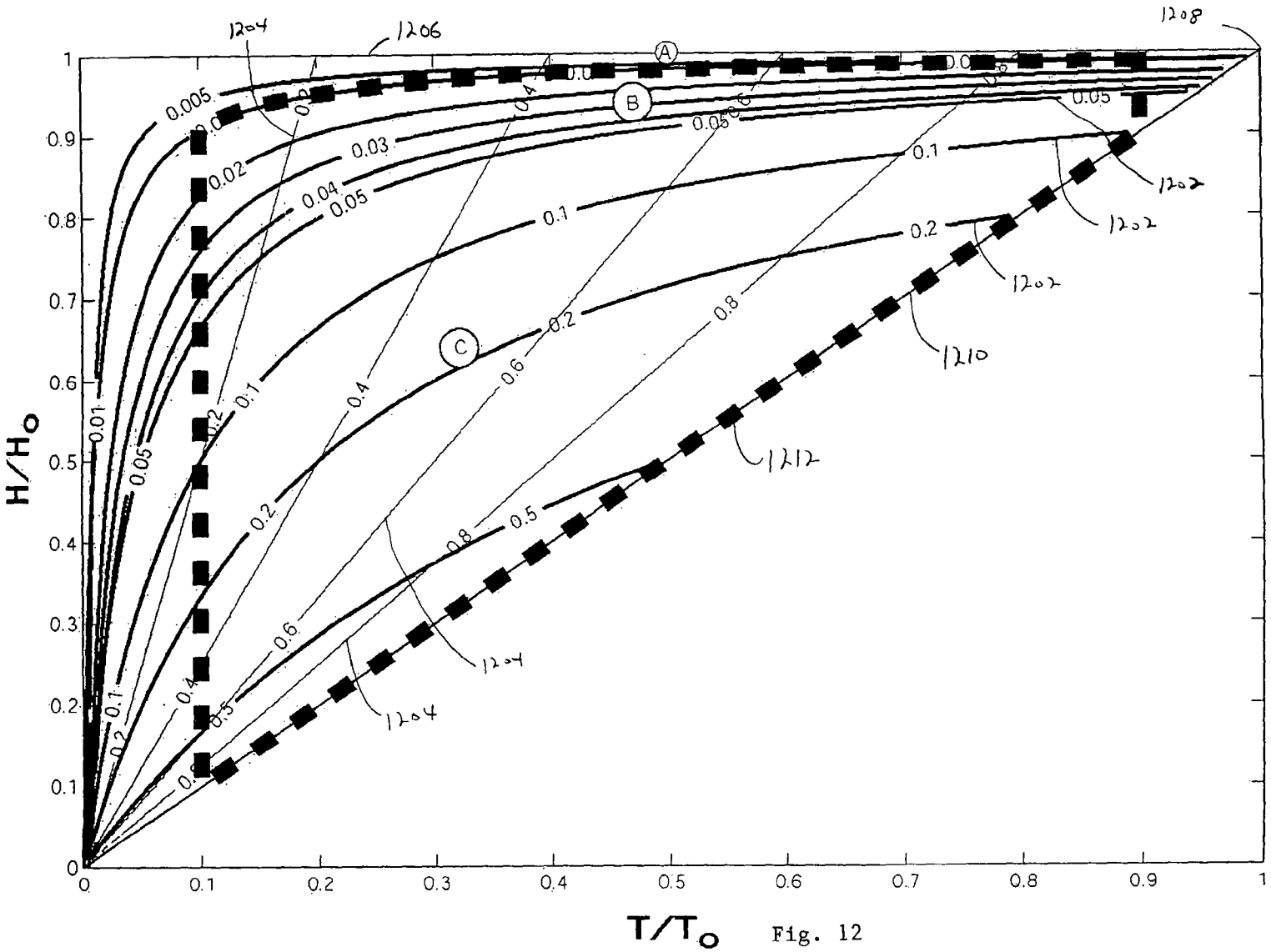
FIG. 12 is a graph showing a parameter space for values of a surface cooling scaling factor, according to another embodiment of the invention.

FIG. 12 shows contours 1202 of several values of E (from 0.005 to 0.5) plotted on a parameter space including $H/H_o$ and $T/T_o$ on the axes. Contours 1204 show values of a dilution factor M which is equal to $Q_o/Q$ described above. At the point of discharge to a receiving water body, $H/H_o$ and $T/T_o$, each equal one (point 1208). As loss of heat to ambient waters and the atmosphere occurs, $T/T_o$ decreases. If the heat loss is due entirely to mixing with ambient waters, a path is traced from point 1208 along line 1206, where it can be seen that intersections of contours 1204 of dilution factor M equal the fractional decrease in temperature, $T/T_o$. If zero mixing with ambient waters occurs, and thus all heat loss is to the atmosphere, then a path is traced from point 1208 along a diagonal line 1210.

As discussed above, many typical discharge systems intentionally mix discharge water with ambient water as quickly as possible, and thus trace a path close to horizontal line 1206. Embodiments of systems and methods described herein are designed to trace paths that pass through an area enclosed by a dashed line 1212, and thus have an E value of at least 0.01.

Another suitable method of calculating E includes evaluating $(1-H/H_o)$ by measuring the surface temperature of the water in the receiving water body, for example with an infrared camera or with a grid of thermistor temperature measurements, and obtaining atmospheric weather measurements at a location sufficiently close to the thermal plume location. Required weather measurements include the 10 m wind speed and atmospheric pressure. This method also requires measurements of $Q_o/Q$ at a specified transect bounding the region within which water surface temperatures are evaluated. This can be evaluated by measuring plume velocities along the specified transect as described above. With this information, the excess heat flux to the atmosphere can be calculated by one of ordinary skill in the art by using a set of well-known formulae for estimating heat flux (e.g., Fischer et al., 1979, p. 163):

$$\Delta H_S = C_H \rho_A C_p W \Delta T \tag{5}$$

$$\Delta H_L = C_E \rho_A L_e W \Delta Q \tag{6}$$

$$\left(1-\frac{H}{H_o}\right)=\frac{(\Delta H_L+\Delta H_S)}{H_o} \tag{7}$$

where ΔT represents the difference between the actual surface water temperature, and the expected ambient surface temperature that would be present in the absence of the thermal plume, and ΔQ is a similar difference for the saturation specific humidity associated with the surface water temperature. $C_H$ and $C_E$ are coefficients generally considered to be on the order of $1.5\times10^{-3}$ (e.g. Fischer et al 1979), $\rho_A$ is the density of air, $C_p$ the specific heat of air, W is the wind speed 10 m above the water surface, and $L_e$ the latent heat of evaporation. With this information, E can be calculated as described in Equation 3.

For purposes herein, either of the above two methods of calculating a value for E is a valid representation of having a value of $E=Q_o/Q*(1-H/H_o)$ in a discharge system, even if some or all of the values on the right hand side of the equation are not explicitly determined.

Methods and system disclosed herein may be implemented with discharges that have an initial heat flux, $H_o$, of greater than two megawatts, greater than ten megawatts, greater than 50 megawatts, greater than 500 megawatts, greater than 1000 megawatts, or any suitable initial heat flux.

Prophetic Example #1

First, we model a system that does not include aspects of the invention disclosed herein. Consider a discharge canal optimized for mixing with the following characteristics:

Temperature difference between discharge and ambient water, ΔT=10° C.;

Flow rate of discharge water, $Q_o=40\ m^3/s$;

Depth of canal, h=4 m; and

Width of canal, b=5 m

Given these initial values, the following values can be calculated from equations defined herein and from standard formulae:

Velocity of discharge water, u=2 m/s;

Excess heat flux discharged to receiving water body, $H_o$=1673 MW; and

Reduced gravity, $g'=0.025\ m/s^2$.

With the assumption that the entire plume exists within a bottom boundary layer, we calculate stress as $\tau=C_D\rho u^2$, where $C_D=3\times10^{-3}$. This yields a stress of 12 Pa. The shear production of turbulent kinetic energy, can be estimated as $$P=\frac{\tau}{\rho}\frac{\partial u}{\partial z}.$$

The amount of TKE converted to potential energy through mixing in a stratified environment is typically taken as B, the buoyancy flux, and can be estimated as B=0.2P. Thus, an estimate for B can be made as approximately $1\times10^{-4}$ W/kg.

Now consider the potential energy increase associated with mixing a unit volume of ambient water into the discharge water, which can be estimated assuming an average increase in height of h/2:

$$E_{MIX}=\rho g'\frac{h}{2}.$$

For the given values, this estimate yields 50 $J/m^3$.

Now a time scale for mixing (roughly considered the time required to dilute by a factor of two, i.e., $M=Q_o/Q\sim0.5$, can be estimated as $$t_{mix}=\frac{E_{mix}}{B\rho}\sim500\ s.$$

During this time period, the plume advances over an area estimated to be equal to $A=t_{mix}ub\sim5000\ m^2$. A representative rate of excess heat loss to the atmosphere can be calculated assuming a typical wind speed of 10 mph, a ΔT value of approximately 6-8° C., to represent a typical difference between the heat loss associated with water of ambient temperature, and the heat loss associated with water with a temperature approximately equal to the discharge temperature, and Equations 5-7, yielding a value on the order of 100 $W/m^2$, which is used here. Thus, the heat loss occurring during the mixing time scale would be approximately 0.5 MW, or approximately 0.03% of the discharged heat flux, as defined above. Assuming a value of M, ~0.5, this results in the point A, as shown in FIG. 12.

We now estimate a value for E in a system using a prophetic weir embodiment example similar to the system illustrated in FIG. 8. The discharge water is directed over a one meter deep weir, 100 m in length, such that the discharge is no longer in contact with the bottom and the velocity is equal to:

$$u=0.4\ m/s.$$

In a shear stratified environment, the buoyancy flux, B, can be estimated following MacDonald and Geyer (2005) as $B\approx14\times10^{-4}\ \mu g'$, yielding $B\sim4\times10^{-6}$ W/kg, for which the appropriate mixing scale is $t_{MIX}\sim12{,}500$ s. A conservative estimate of the plume surface area, as above, yields A~500,000 $m^2$, resulting in an atmospheric heat loss $(1-H/H_o)$ during the mixing time scale on the order of 60 MW, or 3.6% of the total discharged excess heat load. This is shown as point B in FIG. 12, and corresponds to a value of $$E=\frac{Q_o}{Q}\left(1-\frac{H}{H_o}\right)=(0.5)(0.036)=0.018.$$

Prophetic Example #2

A modification to the system described in prophetic example #1 may be made by introducing a moving layer of ambient water underneath the discharge water to separate the shear region from the stratified region. In theory, this separation should shut down mixing completely due to values of $Ri_g$ within the stratified region being much greater than ¼. However, production of unstratified turbulence within the shear layer will occur, which may be transported upward in the water column, eventually impacting the stratified region and resulting in mixing, however, a reduction in mixing on the order of approximately one order of magnitude is reasonable to assume. Thus, the atmospheric heat loss $(1-H/H_o)$ in this prophetic example would be on the order of 36% of the total discharged excess heat load. This result is shown as point C in FIG. 12, corresponding to a value of $$E=\frac{Q_o}{Q}\left(1-\frac{H}{H_o}\right)=(0.5)(0.36)\sim0.2$$

Note that this heat loss is now of the order of the total dilution associated with the discharged fluid (~0.5). Thus, some of the assumptions associated with this estimate may break down, and the point C, might actually be forced to the left, toward lower values of $T/T_o$ in FIG. 12.

The calculations for prophetic examples 1 and 2 are approximate, but should be considered conservative for several reasons, including:

1. Lateral spreading has not been taken into account. The discharged water is lighter than the ambient water and will have a tendency to spread laterally at a speed related to the local internal wave speed (Hetland and MacDonald, in press). This should result in greatly enhanced exposed surface areas, particularly over the longer time scales, with appropriately increased atmospheric heat loss.

2. Mixing has been estimated based on outlet conditions. In reality, mixing will significantly decrease velocity shear, resulting in much lower mixing rates as the plume advances. This will also have a more significant effect over the longer time scales.

Measurements of water velocity, temperature and conductivity can be obtained along a transect perpendicular to the plume centerline using conventional oceanographic instrumentation. A ship-mounted acoustic Doppler current profiler (ADCP) can be used to measure velocities in the water column (e.g. MacDonald et al 2007). In some cases, it may be necessary to tow an upward looking ADCP in order to measure velocities very close to the water surface. In addition, a conductivity temperature depth (CTD) unit can also be towed behind the vessel, either in a "tow-yo" configuration, so that it is raised and lowered as the vessel is underway, resulting in a sawtooth sampling pattern. Alternatively, closely spaced vertical transects can be performed while the vessel holds position (e.g. Chen and MacDonald 2006). A fluorometer can also be used in conjunction with the CTD unit to measure dye concentrations.

Collected velocity, temperature and salinity data can be interpolated onto a rectangular grid, allowing calculation of heat fluxes, volume fluxes, and mean temperature, salinity, or dye concentration values.

For many embodiments, it is desirable for the discharged water to be of lower density than the ambient receiving waters. It is common in many cooling water applications to withdraw water from the same water body into which discharge is occurring, although it is possible to have the source of the discharged water be from an off-site location. If the discharged water is initially withdrawn from a stratified water body (stratification may be due to salinity gradients, as in an estuary, or thermal gradients, as in a freshwater lake, or a combination of the two), the water may be drawn from at or near the surface of the water body in order to intake water of lower density. Because salinity within typical ranges affects density much more strongly than temperature, if water is drawn from lower in the water column, the increased temperature of the discharge may not be sufficient to overcome the natural density difference between the high salinity intake water and the ambient surface waters at the discharge location. Additional environmental benefits, including a potential reduction in the entrainment of fish eggs, larvae, and other biological specimens, which are often found in higher abundance in bottom waters than in near-surface waters, may also be derived from a surface- or near-surface intake, as opposed to a deeper intake.

Having thus described several aspects of at least some embodiments of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A system for transferring heat from cooling system discharge water to the atmosphere, the system comprising:

a discharge conduit configured to receive cooling system discharge water from a cooling system, and further configured to deliver the cooling system discharge water at an initial temperature $T_o$ to a large receiving water body containing ambient water;

wherein the system is constructed and arranged to limit mixing of the discharge water with the ambient water to such an extent that a surface cooling scaling factor, E, defined as:

$$E = \frac{Q_o}{Q}\left(1 - \frac{H}{H_o}\right)$$

is greater than or equal to 0.01 when a ratio $T/T_o$ is less than 0.9 and greater than 0.1, wherein $Q_o$ represents an initial volume flux of discharge water being discharged into the receiving water body, Q represents a volume flux of water including both the initial discharge water volume $Q_o$ and the water into which the initial discharge water volume is mixed, $H_o$ is the initial excess heat flux of volume $Q_o$ of the discharge water, H is the excess heat flux from the discharge water associated with the volume flux Q, and T is the mean temperature associated with volume flux Q.

2. A system as in claim 1, wherein the discharge conduit is constructed and arranged such that the discharge water at a selected flow rate and density lifts off from the bottom of the discharge conduit upstream from a mouth of the conduit or substantially at the mouth of the conduit.

3. A system as in claim 1, further comprising a weir positioned in the conduit and/or the receiving water body, the weir extending from the bottom of the conduit and/or the receiving water body to a height below a top water surface, the weir being configured such that the discharge water flows over the weir and the ambient water does not flow over the weir.

4. A system as in claim 1, further comprising a flow introducer being configured to introduce a cushioning flow of water into the system at a longitudinal position of the system and under the discharge water, the flow introducer being further configured to introduce the cushioning flow of water at an initial velocity substantially equal to or less than a velocity of the discharge water above the cushioning flow of water, and the flow introducer being fluidically connected to a supply of water having a density that is: (a) less than or substantially equal to a density of the discharge water; and (b) greater than or substantially equal to a density of the ambient water.

5. A system as in claim 1, wherein the surface cooling scaling factor E is less than 0.3.

6. A system as in claim 1, wherein the surface cooling scaling factor E is greater than or equal to 0.02.

7. A system as in claim 1, wherein the surface cooling scaling factor E is greater than or equal to 0.2.

8. A system as in claim 1, wherein the initial flux of heat, Ho, is greater than ten megawatts.

9. A system as in claim 1, wherein the initial flux of heat, Ho, is greater than fifty megawatts.

10. A system for transferring heat from cooling system discharge water to the atmosphere, the system comprising:

a discharge conduit configured to receive cooling system discharge water from a cooling system, and further configured to deliver the discharge water of a selected flow rate and density to a large receiving water body at a mouth of the conduit, the discharge conduit having a bottom, a length, a width profile and a depth profile, and the large receiving water body containing water of a selected density;

wherein the discharge conduit is constructed and arranged such that the discharge water having the selected flow rate and density lifts off from the bottom of the discharge conduit upstream from the mouth of the conduit or substantially at the mouth of the conduit, the lift off allowing intrusion of the ambient water under the discharge water.

11. A system as in claim 10, wherein, to initiate lift off of the discharge water, the discharge conduit is constructed and arranged such that a first value of the discharge Froude number of the discharge water flow in the conduit equals substantially one at at least one position that is either upstream of the mouth of the conduit along the longitudinal direction of the conduit or is at the mouth of the conduit for the selected flow rate and density of the discharge water, and a second value of the discharge Froude number of the discharge water flow is less than one downstream of the longitudinal position where the discharge Froude number equals substantially one.

12. A system as in claim 10, wherein the depth profile of the discharge conduit comprises an increase in a distance from a top of a water level in the conduit to the bottom of the conduit in a downstream direction of the conduit to initiate the lift off of the discharge water from the bottom of the conduit.

13. A system as in claim 12, wherein the discharge conduit comprises a weir and the increase in the distance from the top of the water level in the conduit to the bottom of the conduit in the downstream direction comprises an increase in the distance from directly over the weir to downstream of the weir.

14. A system as in claim 10, wherein the discharge conduit comprises an increase in the width of the conduit in a downstream direction of the conduit to initiate the lift off of the discharge water from the bottom of the conduit.

15. A system as in claim 10, further comprising a flow introducer being configured to introduce a cushioning flow of water into the system at a longitudinal position of the system and under the discharge water, the flow introducer being further configured to introduce the cushioning flow of water at an initial velocity substantially equal to or less than a velocity of the discharge water above the cushioning flow of water, and the flow introducer being fluidically connected to a supply of water having a density that is: (a) less than or substantially equal to the density of the discharge water; and (b) greater than or substantially equal to a density of the ambient water.

16. A system for transferring heat from cooling system discharge water to the atmosphere, the system comprising:

a discharge conduit configured to deliver cooling system discharge water of a selected flow rate and density to a large receiving water body at a mouth of the conduit, the receiving water body containing ambient water and having a top water surface and a bed; and a weir positioned at or downstream of the mouth of the conduit, the weir extending from the bed of the receiving water body to a height below the top water surface, the weir being configured such that the discharge water flows over the weir and the ambient water does not flow over the weir.

17. A system as in claim 16, wherein the weir is configured such that at the selected flow rate, the discharge Froude number at the weir is greater than or equal to one.

18. A system as in claim 16, wherein the weir is configured such that at the selected flow rate, the discharge Froude number at the weir is equal to substantially one.

19. A system as in claim 16, wherein the weir comprises an upper end that comprises a concave shape relative to the conduit in a plan view.

20. A system as in claim 16, further comprising a flow introducer being configured to introduce a cushioning flow of water into the system downstream of the weir and under the discharge water, the flow introducer being further configured to introduce the cushioning flow of water at an initial velocity substantially equal to or less than the velocity of the discharge water above the cushioning water, and the flow introducer being fluidically connected to a supply of water having a density that is: (a) less than or substantially equal to the density of the discharge water; and (b) greater than or substantially equal to a density of the ambient water.

21. A system as in claim 1, wherein the surface cooling scaling factor E is greater than or equal to 0.05.

22. A system as in claim 1, wherein the surface cooling scaling factor E is greater than or equal to 0.1.

23. A system as in claim 1, wherein the initial flux of heat, $H_o$, is greater than two megawatts.

24. A system as in claim 1, wherein the initial flux of heat, $H_o$, is greater than five hundred megawatts.

25. A system as in claim 1, wherein the system comprises the large receiving water body.

26. A system as in claim 10, wherein the system comprises the large receiving water body.

27. A system as in claim 19, wherein the concave shape comprises a curved shape.

* * * * *